US007051655B1

(12) United States Patent
Moulard et al.

(10) Patent No.: US 7,051,655 B1
(45) Date of Patent: May 30, 2006

(54) LOW-ENERGY OPTICAL DETONATOR

(75) Inventors: Henry Moulard, Saint Louis la Chaussee (FR); Augustre Ritter, Village Neuf (FR); Jean-Marie Brodbeck, Uffheim (FR)

(73) Assignee: Institut Franco-Allemand de Recherches de Saint-Louis, (FR)

( * ) Notice: Subject to any disclaimer, the term of this patent is extended or adjusted under 35 U.S.C. 154(b) by 0 days.

(21) Appl. No.: 10/277,910

(22) Filed: Oct. 21, 2002

(30) Foreign Application Priority Data

Oct. 26, 2001 (FR) ..... 01 13911

(51) Int. Cl.
*F42C 19/00* (2006.01)

(52) U.S. Cl. ..... 102/201

(58) Field of Classification Search ..... 102/201
See application file for complete search history.

(56) References Cited

U.S. PATENT DOCUMENTS

| | | | | | |
|---|---|---|---|---|---|
| 3,362,329 | A | * | 1/1968 | Epstein | 102/201 |
| 3,528,372 | A | * | 9/1970 | Gardner et al. | 102/201 |
| 3,724,383 | A | * | 4/1973 | Gallaghan et al. | 102/201 |
| 3,791,302 | A | * | 2/1974 | McLeod | 102/201 |
| 3,837,942 | A | * | 9/1974 | Catanzarite | 149/83 |
| 4,343,242 | A | * | 8/1982 | Welk | 102/201 |
| 4,727,808 | A | * | 3/1988 | Wang et al. | 102/202.5 |
| 4,870,903 | A | * | 10/1989 | Carel et al. | 102/201 |
| 4,892,037 | A | * | 1/1990 | Betts | 102/201 |
| 4,917,014 | A | * | 4/1990 | Loughry et al. | 102/201 |
| 5,052,300 | A | * | 10/1991 | Josse | 102/201 |
| 5,148,748 | A | * | 9/1992 | Yarrington | 102/201 |
| 5,406,889 | A | * | 4/1995 | Letendre et al. | 102/201 |
| 5,660,413 | A | * | 8/1997 | Bergerson et al. | 280/741 |
| 6,047,643 | A | * | 4/2000 | Benner et al. | 102/201 |
| 6,374,740 | B1 | * | 4/2002 | Moulard | 102/275.3 |
| 6,467,803 | B1 | * | 10/2002 | Dirmeyer et al. | 280/731 |
| 6,539,868 | B1 | * | 4/2003 | Moulard | 102/201 |

FOREIGN PATENT DOCUMENTS

| | | | | |
|---|---|---|---|---|
| EP | 0 289 184 A1 | * | 11/1988 | 102/201 |
| EP | 0 397 572 | | 11/1990 | |
| EP | 1 067 357 | | 1/2001 | |
| FR | 2 692 346 | | 12/1993 | |
| GB | 2056633 | * | 3/1981 | |
| JP | 04366399 A | * | 12/1992 | |
| WO | 99/00343 | | 1/1999 | |

* cited by examiner

*Primary Examiner*—Stephen M. Johnson
(74) *Attorney, Agent, or Firm*—Bachman & LaPointe, P.C.

(57) ABSTRACT

The invention relates to an optical detonator comprising a secondary explosive disposed in a cavity, an optical fiber having one end connected to a source of laser radiation, and a focusing optical interface situated between the other end of the optical fiber and the secondary explosive and adapted to transmit the laser radiation to the secondary explosive. According to the invention, a layer of an ignition powder is disposed in the cavity between the secondary explosive and the focusing optical interface.

11 Claims, 1 Drawing Sheet

LOW-ENERGY OPTICAL DETONATOR

The present invention relates to low-energy optical detonators in which initiation is performed by a laser source which may be constituted, for example, by a laser diode.

BACKGROUND OF THE INVENTION

A detonator is a device designed to initiate detonation of an external charge of secondary explosive situated downstream therefrom; in order to do that, every detonator contains a small quantity of secondary explosive (100 milligrams (mg) to 1 gram (g)) which needs to be brought to detonation (at least) in its terminal portion starting with energy supplied to the inlet of the detonator from an external source.

In known manner, an optical detonator is a detonator of the type comprising secondary explosive disposed in a cavity, an optical fiber connected at a first end to a source of laser radiation, and a focusing optical interface situated between the other end of the optical fiber and the secondary explosive, and adapted to transmit the laser radiation to the secondary explosive.

In a manner that is entirely conventional in the field of explosives, the term "secondary" explosive is used to designate an explosive that is relatively insensitive, in contrast with "initiating" or "primary" explosives, e.g. lead azide which are very sensitive and thus dangerous.

In low-energy optical detonators (energy less than 10 millijoules (mJ)) that are also of low power (a few watts), the light energy of the laser radiation from a solid laser source in relaxed mode or from a quasi-continuous laser diode (maximum size 1 cubic centimeter ($cm^3$)) is used via an optical fiber for igniting deflagration of the secondary explosive charged at the optical interface.

This heating by absorbing laser radiation via the optical interface is recognized as presenting optical detonators with greater safety in use compared with electrical detonators in which the explosive substance close to the inlet interface is in intimate and permanent contact with a resistive electrical conductor wire that heats when an electrical current passes therethrough and transmits its heat by thermal conduction to the explosive substance coating it, but which can be activated accidentally by unwanted electrostatic discharges or by induced currents due to interfering electromagnetic radiation.

In spite of this undeniable advantage of optical detonators, use thereof poses various problems due to the fact that the secondary explosives used do not absorb light emitted in the near infrared, whether by solid lasers or by laser diodes.

Thus, in order to mitigate that problem, the state of the art teaches doping the secondary explosive optically, i.e. mixing 1% to 3% by weight of ultrafine carbon black (grain size lying in the range 50 nanometers (nm) to 200 nm) with the secondary explosive (grain size close to 3 micrometers (μm)), so that the laser light is absorbed by the carbon black.

Thus, by means of such optical doping, and by focusing the laser light into a spot of diameter lying in the range 50 μm to 100 μm, the energy threshold of the igniting laser is reduced, thereby making it possible to ensure that the explosive composition is ignited thermally even when using laser diodes that deliver nominal power of 1 watt during a period of 10 milliseconds (ms).

Nevertheless, during operational tests for validating the use of detonators in severe operating environments (use in airplanes, missiles, space vehicles, . . . ) and which are performed either after intense thermal shocks (testing at ambient temperature after being subjected for 5 hours to temperatures above 100° C.), or else after thermal cycling (−160° C. to 100° C.), it has been found that laser ignition of the explosive composition that has been optically doped with carbon black is not sufficiently reliable.

This lack of reliability relates most particularly to nitramines (octogen and hexogen) which are the secondary explosives in most common use for these applications.

Crystals of organic secondary explosive have a coefficient of thermal expansion that is much greater (three times to seven times) than that of the materials used for making a detonator (the silica of the optical interface, stainless steel, or Inconel for the charge-containing body). Thus, when the stresses due to thermal shocks are released, cracks appear in the compressed explosive composition in the vicinity of the optical interface, and as a result the distribution of carbon black in the explosive composition is no longer uniform. Consequently, the secondary explosive is no longer adequately coated in carbon black, thereby sharply increasing the ignition energy threshold and reducing the effectiveness of the optical doping.

OBJECTS AND SUMMARY OF THE INVENTION

The problem posed is that of making a low-energy optical detonator in which the effectiveness of the ignition device is reliable and high, particularly when such a detonator is for use in severe environments.

According to the invention, a layer of pyrotechnics is deposited in the cavity of the optical detonator of the above-specified type, between the secondary explosive and the focusing optical interface.

In the prior art relating to pyrotechnics, which are constituted essentially by a mixture of an oxidizing chemical and a reducing chemical, it is found that they are used to ignite the combustion of the propulsive powders that are used in particular for accelerating a projectile.

Propulsive powders are generally used in large quantities, a 120 mm cannon uses about 8 kilograms (kg) of propulsive powder in a 10 liter (l) chamber—and igniting the combustion of such a large volume is difficult, making it necessary to use an ignitor squib containing an pyrotechnics.

The squibs used for igniting propulsive powders are electrical squibs in which the pyrotechnics is ignited by thermal conduction of the heat given off by electric wires, with the chemical reaction between the oxidizer and the reducer being started when a very small quantity of the pyrotechnics has reached the critical starting temperature for said reaction (typically 400° C.).

It is quite surprising to use an pyrotechnics for igniting a detonator, the technical field of detonators being quite different from that of the squibs used for igniting the propulsive powder of guns or the solid propellant of thrusters.

In guns and thrusters, squibs or ignitors are used to obtain controlled combustion of a propellent powder that generates pressure that is fairly low (a maximum of 5000 bars in a gun), with the speeds of the corresponding combustion fronts being at best a few meters per second ($m \cdot s^{-1}$). In detonators, the objective is to achieve detonation, i.e. combustion that is extremely fast and that generates very high pressure (in the range 300,000 bars to 400,000 bars), with the speed of the detonation wave propagating at values lying in the range 7000 $m \cdot s^{-1}$ to 9000 $m \cdot s^{-1}$.

Furthermore, the combustion of the pyrotechnics used in electrical squibs is generated by the high temperature given off by the resistive wires. In contrast, in the present invention, the pyrotechnics are ignited by absorbing photons of light energy.

By using an optical detonator comprising an pyrotechnics in accordance with the present invention, the reliability thereof is increased very considerably compared with detonators using optical dopants, and this applies in particular to detonators for use in severe environmental conditions.

Furthermore, the time required to trigger detonators of the present invention is divided by a factor of 5 or even 10 compared with detonators that are optically doped.

BRIEF DESCRIPTION OF THE DRAWINGS

Other features and advantages of the present invention appear from the following description.

In the accompanying drawing given as non-limiting examples.

MORE DETAILED DESCRIPTION

Figure 1:
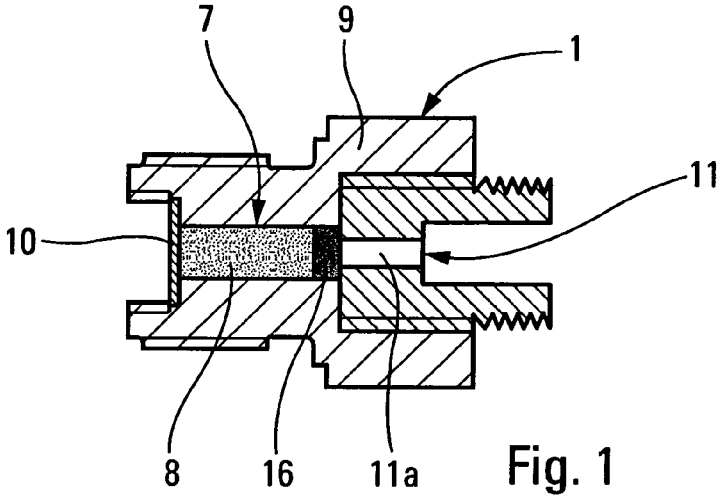
FIG. 1 is a longitudinal section view of the first stage of an optical detonator of the present invention.

As can be seen in the accompanying figures, the optical detonator 1 comprises an endpiece 2, a first stage 3, and a second stage 4.

The endpiece 2 serves as a support for an optical fiber 5 having a first end connected to a laser source and having its second end 6 free.

The first stage 3 comprises a housing 7 having confined therein a deflagrating secondary explosive 8. Confinement is achieved by the walls of the structure 9 of the first stage 3, a device 10 serving to trigger transition to detonation in the second stage 4 at a first end, and a focusing optical interface 11 at the other end.

Once the endpiece 2 has been secured to the first stage 3 of the detonator 1, the second end 6 of the optical fiber 5 is in the immediate vicinity of the focusing optical interface 11, said interface 11 serving to separate the housing 7 from the optical fiber 5.

The second stage 4 has a housing 12 with a detonating secondary explosive 13 confined therein. This confinement is provided by the walls of the structure 14 of the second stage 4, the device 10 serving to trigger the transition to detonation in the second stage 4, and a plate 15 which is propelled during detonation of the second stage 4.

In the invention, an pyrotechnics 16 is placed in the housing 7 of the first stage 3 between the deflagrating secondary explosive 8 and the focusing optical interface 11.

Figure 3:
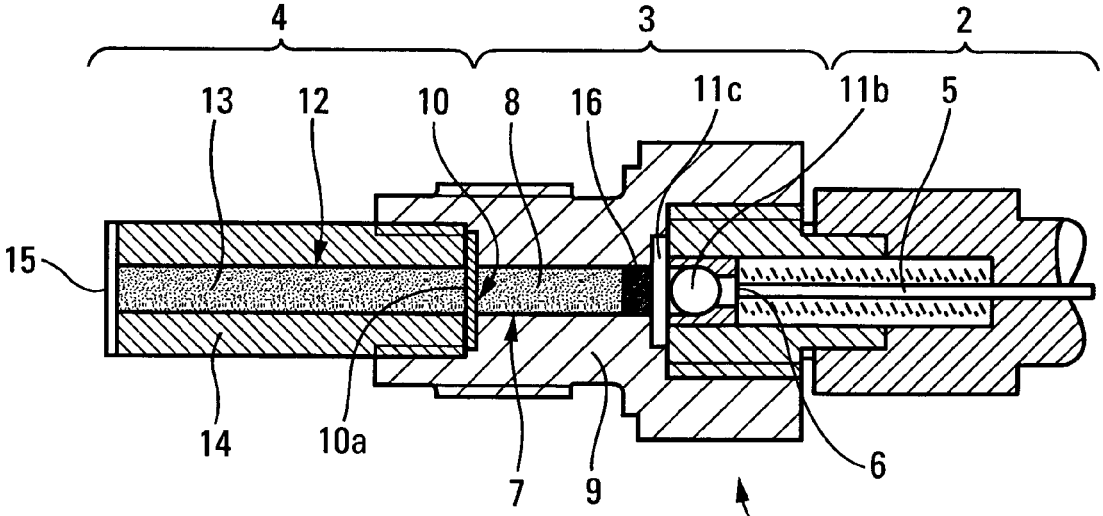
FIG. 3 is a longitudinal section view of an optical detonator of the present invention, with the transition in the second stage being of the deflagration-detonation type.

The operation of a detonator 1 as shown in FIG. 3 is as follows.

Initially, the laser source is activated.

The infrared laser light is transported by the optical fiber 5 and is focused on the pyrotechnics 16 by the focusing optical interface 11 which comprises a glass bead 11*b* associated with a glass plate 11*c*.

Secondly, the pyrotechnics 16 situated in the first stage 3 is ignited by absorbing the infrared light from the laser and it is consequently subject to combustion. One of the components of the pyrotechnics 16, either the oxidizer or the reducer (the usual case) absorbs light energy as delivered by radiation in the near infrared. Reducing metals in micronized form present this light-absorbing property.

The laser ignition threshold of the pyrotechnics 16 depends on its packing density, on the stoichiometry, and on the grain size of its components.

The compacting pressure of the pyrotechnics 16 is advantageously selected to be equal to that of the deflagrating secondary explosive 8, the packing density of said deflagrating secondary explosive 8 being greater than 80% of its theoretical maximum density.

The use of an pyrotechnics 16 under conditions close to stoichiometry makes it possible to reduce the ignition energy threshold of the pyrotechnics 16. Nevertheless, for safety reasons while handling the pyrotechnics 16, it is preferable to have a mixture that is within 15% of stoichiometric conditions.

Similarly, the use of an pyrotechnics 16 of small grain size makes it possible to reduce its laser ignition threshold. Effective focusing of the laser spot by the optical interface 11 as is needed to reduce the laser ignition energy threshold requires the laser spot to be reduced to a diameter of 50 μm to 100 μm, such that the reducing metals used are in micronized form (grain size smaller than 10 μm) in order to increase absorption in the near infrared. The inorganic oxidizer preferably has similar grain size.

In general, these parameters are adjusted as a compromise between safety in the use of explosive substances and operating performance.

Thirdly, the deflagrating secondary explosive 8 situated in the first stage 3 is ignited by the combustion of the pyrotechnics 16 with which it is in contact.

The combustion reaction of the pyrotechnics 16 (an oxidation-reduction reaction) is exothermal and releases a large amount of reaction heat, enabling deflagration of the secondary explosive 8 which is in contact with said layer of pyrotechnics 16 to be started in reliable and immediate manner.

It should be observed that although this pyrotechnics 16 releases a large amount of heat which is favorable to igniting the deflagrating explosive 8, nevertheless on its own it releases too little gas to be able to replace the secondary explosive, which restricts its use to igniting them.

Fourthly, the detonating secondary explosive 13 situated in the second stage 4 is initiated in detonation by transmission of the energy given off by the deflagrating secondary explosive 8.

The transition to detonation conditions is triggered by the deflagration of the deflagrating secondary explosive 8: deflagration causes the charge of detonating secondary explosive 13 to be compacted dynamically. The great porosity of the explosive 13 (its compactness is close to 50%, the explosive having large grain size and being packed at low density) and the use of the disk 10*a* (which breaks into a foil and acts as a piston compressing the column of porous detonating secondary explosive 13) encourages the deflagration-detonation transition over a short distance.

Fifthly, the plate 15 is propelled by the detonation of the detonating secondary explosive 13, thereby initiating detonation of the external charge of secondary explosive.

Figure 2:
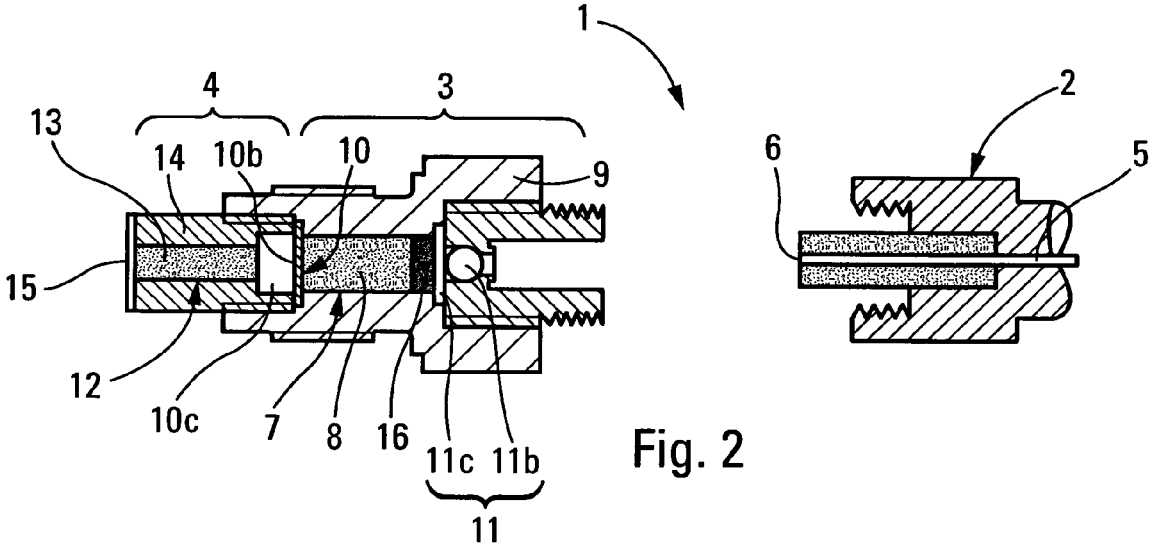
FIG. 2 is a longitudinal section view of an optical detonator of the present invention, with the transition in the second stage being of the shock-detonation type.

The operation of the detonator 1 shown in FIG. 2 differs from that shown in FIG. 3 solely in the initiation of the detonating secondary explosive 13.

In the detonator 1 shown in FIG. 2, the transition to detonation conditions is triggered by the shock wave which is created by the impact of the projectile disk 10*b* propelled into the cavity 10*c* by the deflagration of the deflagrating secondary explosive 8, said shock wave being focused on the bare surface of the detonating secondary explosive 13 by the configuration of the cavity 10*c*.

Preferably, in this shock-detonation transition (described in patent French application No. 2 796 172), the detonating secondary explosive 13 is of fine grain size and is packed with density that is higher than of the detonating secondary explosives 13 used in deflagration-detonation transition detonators.

Naturally, it is possible for the focusing optical interface 11 to be implemented as a glass bar 11*a* of graded index (as shown in FIG. 1) instead of as a glass bead 11*b* associated with a glass plate 11*c* (as shown in FIGS. 2 and 3).

In the prior art, carbon black used for picking up light energy and transmitting energy by thermal conduction needed to be mixed in uniform manner with the deflagrating secondary explosive 8.

In addition, since carbon black or any other optical dopant is chemically inert and does not participate in any exothermal chemical reaction, it is necessary to use it in very small quantities in order to avoid reducing the total chemical energy contained in the secondary explosive mixture.

A first advantage of pyrotechnics 16 is that they absorb laser light easily. The pyrotechnics 16 does not need to be mixed with any kind of optical dopant, it is ignited by its own ability to absorb light energy.

A second advantage of pyrotechnics 16 is that they are chemically reactive. The pyrotechnics 16 is subjected to combustion (an exothermal chemical reaction) and the flame of that combustion initiates combustion of the deflagrating secondary explosive 8. The pyrotechnics 16 does not need to be mixed with the secondary explosive 8, it suffices for the pyrotechnics 16 to be in contact with the deflagrating secondary explosive 8.

Since there is no need during preparation of the detonator 1 to make any kind of uniform mixture (a difficult operation) with the pyrotechnics 16 (neither with carbon black nor with a secondary explosive), preparation of the detonator 1 is greatly facilitated.

Another particularly advantageous consequence of the chemical composition of pyrotechnics 16 is that it is possible to have a much higher percentage of light-absorbing material per unit volume (the percentage of carbon black being about 1%), thereby considerably increasing ignition of the deflagrating secondary explosive 8.

The pyrotechnics 16 serves only to ignite deflagration of the deflagrating secondary explosive 8 which remains the majority energy material of the first stage 3. Only a fine layer of pyrotechnics 16 is needed, having thickness lying in the range one-fourth to one-tenth the thickness of the deflagrating secondary explosive 8. For example, thickness lying in the range 0.5 mm to 1 mm for pyrotechnics 16 adjacent to a 4 mm thick layer of deflagrating secondary explosive 8 (e.g. octogen) suffices to implement deflagration enabling the detonating secondary explosive 13 to be initiated.

A third advantage of pyrotechnics 16 is that they enable the time required for triggering the detonator to be divided by a factor of 5 or even 10.

The time taken to ignite the pyrotechnics 16 by absorbing laser radiation, to cause this pyrotechnics 16 to start its oxidation-reduction chemical reaction, and to transmit the heat of this exothermal reaction to the secondary explosive 8, enabling it to deflagrate, is shorter than the time taken by carbon black to absorb the laser radiation and to transmit energy by thermal conduction to the secondary explosive enabling it to deflagrate.

The exothermal chemical reaction of pyrotechnics combustion releases reaction heat that is greater (+100%) than the heat released by decomposition of the secondary explosive that is optically doped by carbon black, such that this greater reaction heat enables deflagration of the secondary explosive 8 in contact with said pyrotechnics 16 to be started quickly and immediately.

A fourth advantage of pyrotechnics 16 is that they are physically stable.

The ignition powder pyrotechnics 16 is physically much more stable when subjected to tests for ability to withstand shocks and thermal cycles, and consequently it remains intact in contact with the optical interface 11. The pyrotechnics 16 possesses a thermal expansion coefficient that is smaller than that of the organic secondary explosive. For example, zirconium which is one of the reducing metals that may be used in such powders has a coefficient that is one-tenth that of octogen.

Advantageously, the pyrotechnics 16 is a redox powder comprising a mixture of reducing metal and inorganic oxidizers. Such pyrotechnics 16 absorb infrared laser light easily and have a particularly high flame temperature.

By way of example, reducing metals are zirconium, zirconium-nickel alloys, titanium, titanium hydrides, aluminum, and magnesium.

The inorganic oxidizers used are, for example, potassium perchlorate, ammonium perchlorate, ammonium nitrate, ammonium bichromate, barium chromate, and iron oxides.

Thus, the pyrotechnics 16 can comprise the following:

thermites comprising aluminum and iron oxide; and powders of the ZPP type, i.e. essentially containing zirconium and potassium perchlorate, for example a mixture comprising 52% zirconium, 42% potassium perchlorate, 5% Viton; and 1% graphite (percentages by weight).

It is possible to use other redox powders, such as the following, for example:

a powder essentially comprising zirconium and barium chromate, e.g. a mixture comprising 45% zirconium, 34% barium chromate, 7% ammonium bichromate, and 14% ammonium perchlorate (percentages by weight);

a powder essentially containing titanium and potassium perchlorate, e.g. a mixture comprising 40% titanium and 60% potassium perchlorate (percentages by weight), or a mixture comprising 40% titanium hydride $TiH_x$ and 60% potassium perchlorate (percentages by weight), where x is equal to 0.2, 0.65, or 1.65.

Naturally, the invention is not limited to the above-described pyrotechnics. Other powders that absorb laser light and that generate exothermal reactions may be suitable.

What is claimed is:

1. An optical detonator comprising a secondary explosive disposed in a cavity, an optical fiber having one end connected to a source of laser radiation, and said source of laser radiation being a laser diode, and a focusing optical interface situated between the other end of the optical fiber and the secondary explosive and adapted to transmit the laser radiation to the secondary explosive, wherein a layer of pyrotechnics is disposed in the cavity between the secondary explosive and the focusing optical interface, said pyrotechnics containing a metal in micronized powder form having a grain size smaller than 10 μm.

2. An optical detonator according to claim 1, wherein the thickness of the layer of pyrotechnics lies in the range of one-fourth to one-tenth the thickness of the secondary explosive.

3. An optical detonator according to claim 1, wherein the pressure to which the pyrotechnics is compacted is substantially equal to the pressure to which the secondary explosive is compacted.

4. An optical detonator according to claim 1, wherein the composition of the pyrotechnics is stoichiometric to within 15%.

5. An optical detonator according to claim 1, wherein the pyrotechnics is selected from the group consisting of thermites comprising aluminum and iron oxide, powders essentially comprising zirconium and potassium perchlorate, powders essentially comprising zirconium and barium chromate, powders essentially comprising titanium and potassium perchlorate, and powders essentially comprising titanium hydride and potassium perchlorate.

6. An optical detonator according to claim 1, wherein the pyrotechnics has a reducing metal selected from the group consisting of titanium, a titanium hydrides, aluminum and magnesium.

7. An optical detonator according to claim 1, wherein the pyrotechnics has an inorganic oxidizer which is at least one of potassium perchlorate, ammonium perchlorate, barium chromate, ammonium bichromate, ammonium nitrate, and iron oxides.

8. An optical detonator according to claim 1, wherein a transition to detonation conditions is triggered by deflagration of the secondary explosive.

9. An optical detonator according to claim 1, wherein a transition to detonation conditions is triggered by a shock wave created by an impact of a projectile disk propelled into the cavity by deflagration of the secondary explosive.

10. The optical detonator according to claim 1, wherein said focusing optical interface is adapted to generate a laser spot having a diameter of 50 μm to 100 μm.

11. The optical detonator according to claim 1, wherein said pyrotechnics comprises pyrotechnic compounds containing a reducing metal absorbing the infrared radiation of the laser beam.

* * * * *